United States Patent [19]

Honda

[11] Patent Number: 4,604,928

[45] Date of Patent: Aug. 12, 1986

[54] SECTION CONVEYING AND COOLING APPARATUS

[75] Inventor: Masahiro Honda, Ube, Japan

[73] Assignee: Ube Industries, Ltd., Yamaguchi, Japan

[21] Appl. No.: 768,976

[22] Filed: Aug. 23, 1985

[30] Foreign Application Priority Data

Aug. 28, 1984 [JP] Japan ..... 59-177567[U]

[51] Int. Cl.[4] ..... B26D 7/06; B23D 45/02

[52] U.S. Cl. ..... 83/151; 83/153; 83/157; 83/160; 198/465.1

[58] Field of Search ..... 198/465.1, 465.3; 83/151, 153, 157, 155, 158, 160

[56] References Cited

U.S. PATENT DOCUMENTS 4,307,594 12/1981 Steinbock ..... 83/158 X
4,468,165 8/1984 Kawasaki ..... 198/465.1 X
4,516,307 5/1985 Beard ..... 198/465.1 X

FOREIGN PATENT DOCUMENTS 2444535 8/1980 France ..... 198/465.1

*Primary Examiner*—James M. Meister
*Attorney, Agent, or Firm*—Townsend & Townsend

[57] ABSTRACT

An apparatus for automatically conveying and cooling the cut sections is described. The head and tail of each section are grasped and pulled by head and tail chuck which are moved by respective chuck conveyors. The head chuck conveyor is constituted of a endless chain which has an engaging mechanism for engaging with the head chuck when the head chuck moves horizontally and release the head chuck when the head chuck moves vertically. The tail chuck conveyor includes a chain for conveying the tail chucks from the conveyance starting position to end position, and other path and carriage for returning the tail chucks from the conveyance end position to the start position.

7 Claims, 7 Drawing Figures

SECTION CONVEYING AND COOLING APPARATUS

BACKGROUND OF THE INVENTION

This invention relates to an apparatus for conveying under tension a long section sent out from an extruder or a rolling mill in order to cool the section until next process.

A member of aluminum, copper or steel, in the form of a pipe or shape steel, for example, sent out continuously from a extruder of a rolling mill is conveyed in the longitudinal direction and then cut into so called sections each having a predetermined length. The sections are then turned ninety degrees and sent to a starting position of a conveying and cooling. While being conveyed in parallel, the sections are cooled by natural cooling or by fans, and then conveyed to a conveyer belt leading to the next step or a collecting station.

When such sections are conveyed and cooled without being supported, the sections would bent or shrink due to cooling. For the purpose of preventing these problems, it has been proposed a section conveying apparatus in which both ends of the section are clamped by chucks so as to convey them under tension.

With the prior art apparatus, the opposite ends, which are referred to head and tail, of the sections conveyed to the starting position of the cooling table are manually clamped by head chucks and tail chucks which run together with a chain while the sections are stopped. After the manual clumping of the section by the head chuck and the tail chuck, the chain is moved to convey and cool the section. The above described procedure is repeated. Accordingly, the work for mounting the sections on the chucks is troublesome and dangerous, and the complete automation of the section conveying and cooling has been desired.

SUMMARY OF THE INVENTION

Accordingly, it is an object of this invention to provide an automatic apparatus capable of conveying and cooling a long section regardless of its shrinkage, bending and twisting.

According to this invention, for accomplishing this object, there is provided a section conveying and cooling apparatus comprising an elongated table for supporting a member continuously supplied thereto at a start point of conveyance and cooling; a cutter provided for the table for cutting the member into sections of predetermined length; a plurality of head chucks for grasping head ends of the sections; a plurality of tail chucks for grasping tail ends of the sections, each ones of the head and tail chucks including means for grasping the sections and means for adjusting pulling forces applied to the sections and the head chucks and tail chucks in pair sequentially conveying the sections in the direction perpendicular to the sections while maintaining the sections in parallel and at equal distances; head chuck moving means provided at the head side of the section, which runs along an endless path including forward, downward, rearward and upward paths which are contained in a plane perpendicular to an axis of the section, between a conveyance and cooling starting position and a conveyance and cooling ending position, and which has the chuck engaging means for engaging with the head chuck while it is moved horizontally but releasing the head chuck while the same is moved in the vertical direction; head chuck elevating means provided at forward and rearward limit positions of the head chuck moving means for raising and lowering the head chuck; tail chuck moving means which is disposed on the tail side of the section to intersect the same and forwardly moved at the equal speed as the head chuck moving means, and which includes a holding means for holding the tail chucks at the same spacing as the head chucks between the conveyance and cooling start and end positions; and tail chuck returning means for transferring the tail chuck from the conveyance and cooling end position of the tail chuck moving means to the conveyance and cooling start position.

DESCRIPTION OF THE PREFERRED EMBODIMENT

The preferred embodiment of the present invention will be described in detail with reference to the accompanying drawings.

Figure 1:
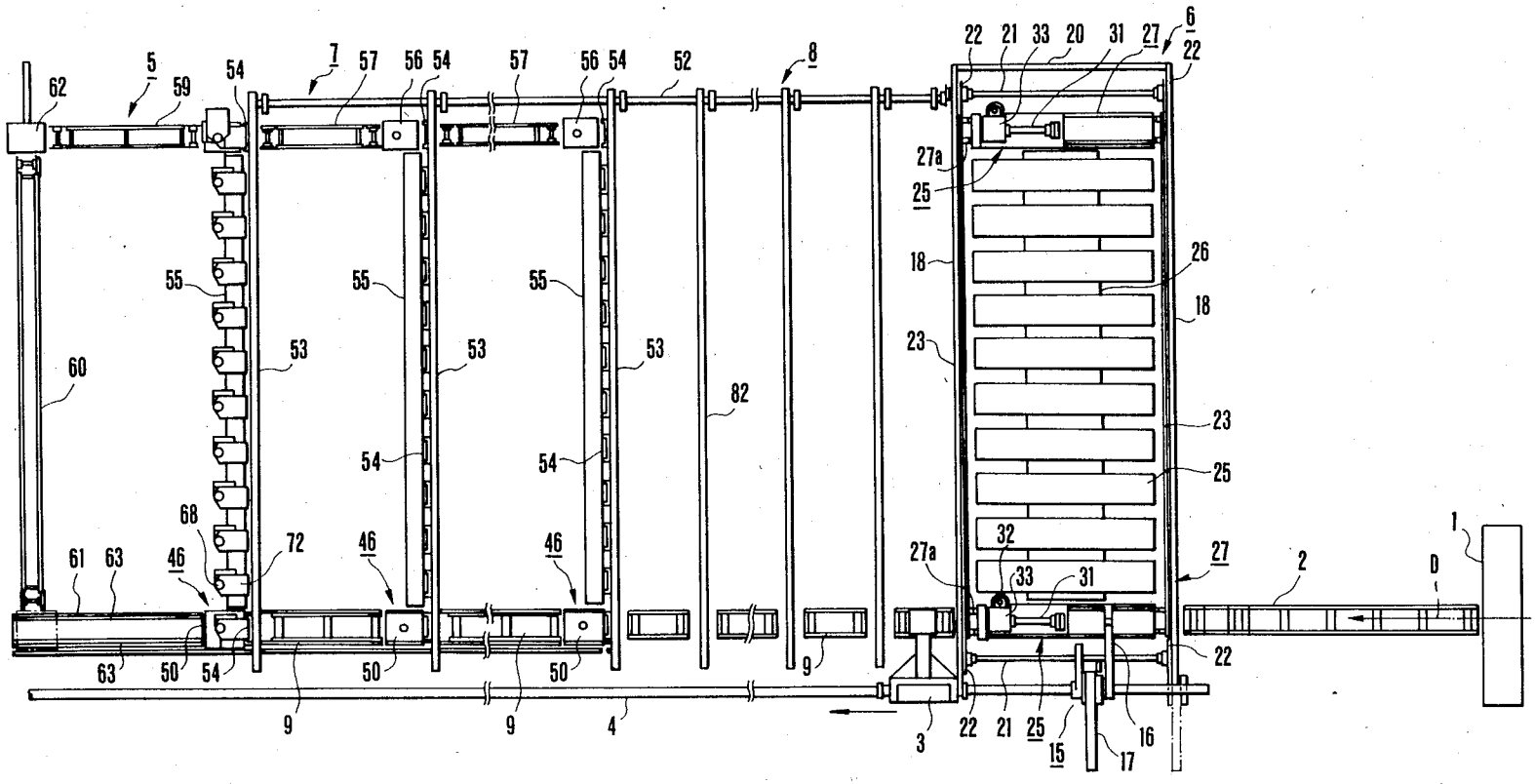
FIG. 1 is a plan view showing one embodiment of the conveying and cooling apparatus according to this invention

FIGS. 1–7 show a section conveying and cooling apparatus according to this invention which is used to cool and convey the cut sections extruded from an extruder, not shown. In FIG. 1, an end platen of the end of an extruder is designated by a reference numeral 1. A high temperature member is extruded in the direction of arrow D so as to move on rollers of a roller conveyor type initial frame 2. A puller 3 is provided to grasp and pull the leading end of the extruded member. The puller 3 is supported by a rail 4 extending in parallel with the direction of extrusion D and driven by a source of drive contained in the puller 3 so as to convey the extruded member at the same speed as the extrusion speed and then stop the extruded member at a predetermined position. The extruded member is cut into sections by a cutting device 15 as described later.

There are also provided a head chuck unit 6 including a plurality of head chucks 25 for gasping and conveying one end of the section, that is head, a tail chuck unit 7 including a plurality of tail chucks 64 for grasping and conveying the other end of the section, that is tail, an intermediate conveyer unit 8 including a chain conveyor 82 disposed between the head chuck unit 6 and the tail chuck unit 7 for conveying the intermediate portion of the section, and a tail chuck return unit 5 for returning tail chucks 64 to a conveyance starting position from an conveyance end position. These units will be described later in detail.

A plurality of run out tables 9 are juxtaposed in the direction of extrusion, the tables 9 being provided for a portion of the tail chuck unit 7 and the intermediate conveyor unit 8 for supporting the section which has been conveyed by the puller 3 and then stoped. The run out tables are driven in the vertical direction (normal to the sheet of drawing).

A cutting device 15 is provided for cutting the extruded member from the extruder and stopped at a predetermined position into sections of a definite length. The cutting device 15 comprises a clamping member 16 opened and closed by an air cylinder and a saw 17 which is reciprocated while rotating. The cutter 15 is supported by the rail 4 extending to the head chuck unit 6. The cutter 15 is adjustably moved between a solid line position and a dot and dash line position in accordance with the length of the sections.

The head chuck unit 6 which grasps and conveys the head of a section cut by the saw 17 will be described as follows.

Figure 2:
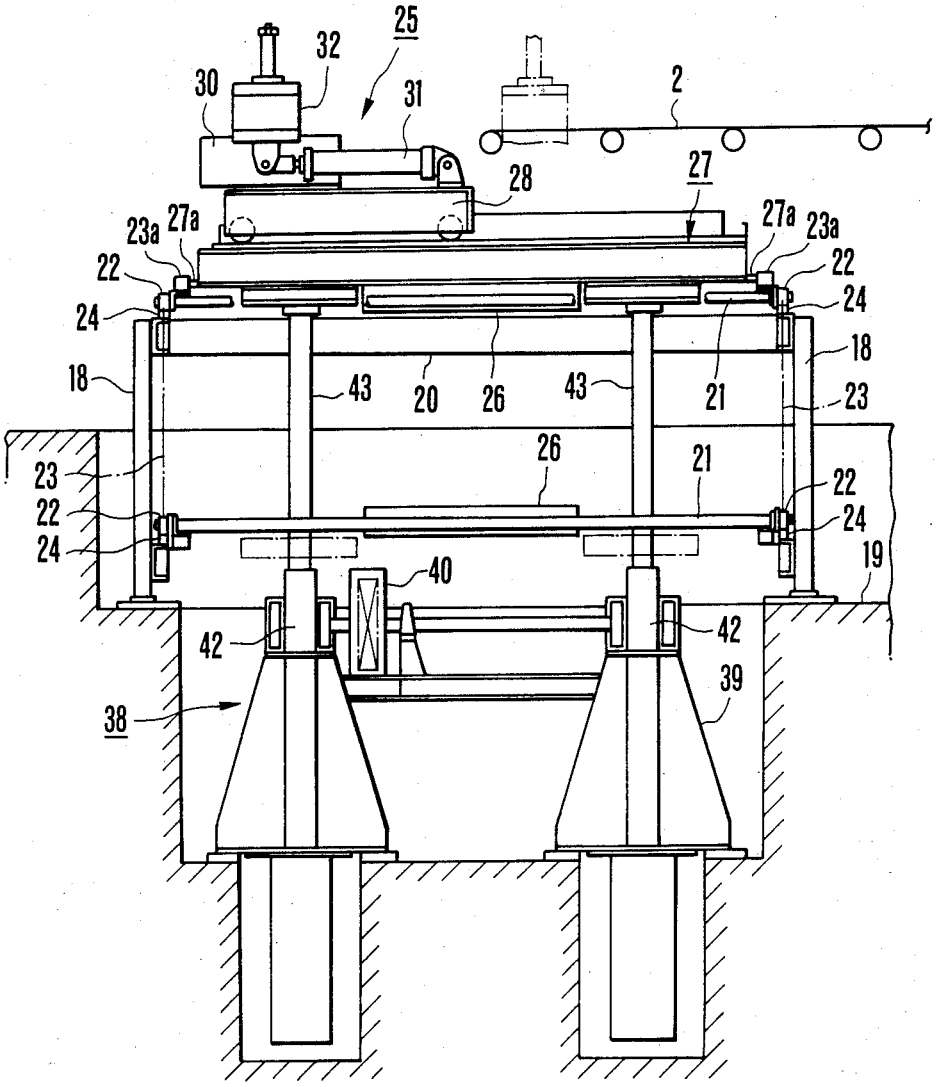
FIG. 2 is a front view of the righthand portion of the apparatus shown in FIG. 1.
Figure 3:
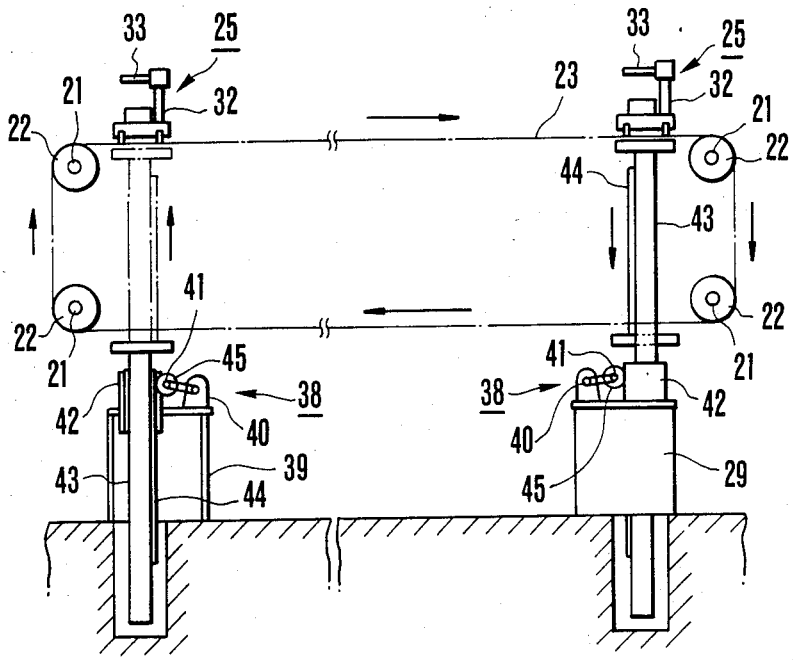
FIG. 3 is a rightside end view of the apparatus shown in FIG. 1.

FIG. 2 and FIG. 3 are the front view and the right-side view of the head chuck unit 6. Referring to FIGS. 1, 2 and 3, the left and right frames 18 of the head chuck unit 6 are provided vertically on a pit floor 19 and extend from the front side to the rear side of the head chuck unit 6 at right angles with respect to the section. The front and rear ends of the frames 18 are interconnected by the rail 4 and a stay 20 respectively. Four parallel sprocket shafts 21 are supported by the right and left frames 18 at the upper and lower front ends and the upper and lower rear ends of the frames 18. Sprocket wheels 22 are secured to both ends of each sprocket shaft 21 and right and left endless chains 23 are passed about the sprocket wheels 22 respectively. The endless chains 23 are driven by the conveyor shaft 52 of the intermediate conveyor unit 8 which is described later. The endless chains 23 are driven in synchronism and rotated intermittently at a predetermined period along the endless path including forward, downward, rearward and upward paths. Chain guides 24 are secured to beams near the frames 18 for guiding the endless chains 23.

A plurality of head chucks 25 are juxtaposed at a definite spacing between the upper runs and lower runs of the left and right chains (in this example, twelve chucks between each pair of runs). The ten head chucks 25 except the foremost and rearmost ones are supported by upper and lower supporting plates 26 so that the head chucks can not descend.

Figure 4:
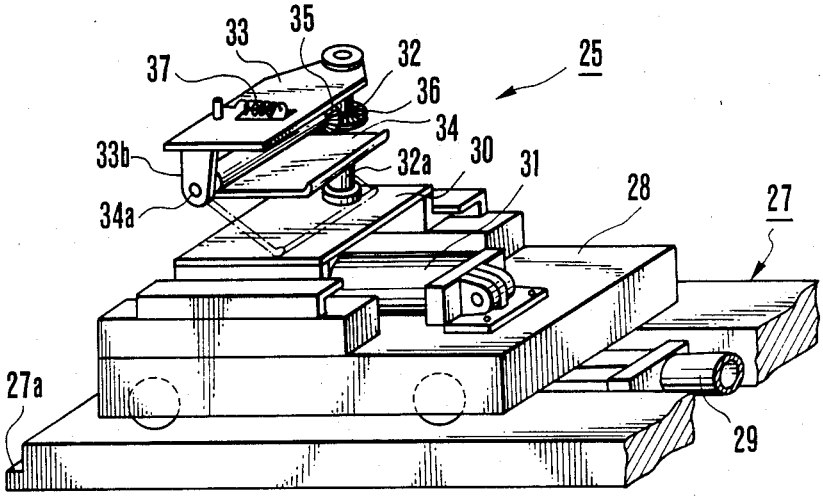
FIG. 4 is a perspective view of a head chuck utilized in this invention.
Figure 5:
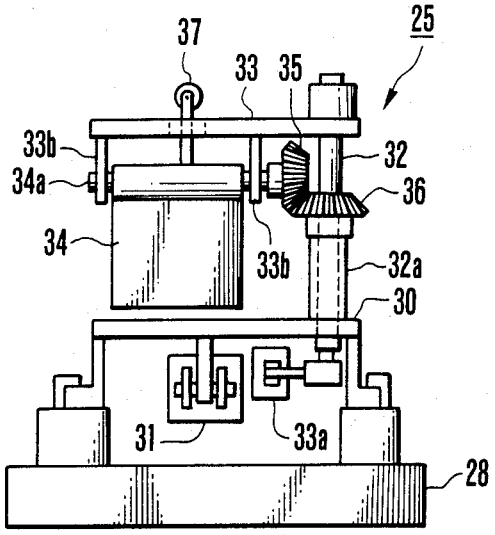
FIG. 5 is a side view of the head chuck shown in FIG. 4.

FIGS. 4 and 5 show a perspective view and a side views respectively of the head chuck 25. The head chuck 25 is runned intermittently together with the chain 23 by the engagement of a pushers 23*a* secured to the chain 23 at the same pitch as the head chucks 25 and the projections projecting on both sides of an base plate 27. The formost and rearmost head chucks 25 are moved in the vertical direction by a head chuck lifter 38 to be described later.

A movable base plate 28 having a length of one half of the base plate 27 of the head chuck 25 supported by the base plate 27 is supported to be horizontally movable in the longitudinal direction of the head chuck 25. The movable plate 28 is reciprocated by an air cylinder 29 to correspond to the length of the section. A chuck plate 30 is supported by the movable base plate 28 to be slidable in the horizontal direction by air cylinder 31 so as to adjust the tension or pulling force applied to the section by the head chucks 25.

Furthermore, as shown in FIGS. 4 and 5, a vertical bearing 32*a* is secured to the rear end of a chuck plate 30 for rotatably journalling a shaft 32 to be rotated by an air cylinder 33*a*. A chuck supporting plate 33 is secured to the upper end of shaft 32 to extend horizontally so that the plate 33 is rotated ninety degrees together with shaft 32 to selectively assume a position in which the plate 33 projects towards the forward and a position in which the plate 33 projects toward the right as viewed in FIG. 1. A square chuck plate 34 is supported by a bearing lever 33*b* of the chuck supporting plate 33 and a bevel gear 35 secured to a pivot pin 34*a* of the square plate 34 meshes with a bevel gear 36 secured to the shaft 32. Portions of bevel gears 35 and 36 are removed so that at the start of rotation of the chuck supporting plate 33, the chuck plate 34 would not be rotated and at the end of rotation of the chuck supporting plate 33, the chuck plate 34 would be rotated from solid line position to a dot and dash line position shown in FIG. 4 by the meshing of bevel gears 35 and 36. When the chuck plate 34 is maintained horizontal and the chuck supporting plate 33 projects toward right as viewed in FIG. 1, the puller 3 permits the passage of the uncut section being conveyed, whereas when the chuck plate 34 is inclined and the chuck supporting plate 33 projects forwardly as viewed in FIG. 1, the chuck plate 34 holds the cut end or head of the section between it and the chuck plate 30. A spring 37 is provided for urging chuck plate 34 in the opening direction. Respective air cylinders 29, 31 and 33*a* are connected to an air bomb acting as an accumulator. At the conveyance and cooling starting position, a coupler to the air bomb is connected to maintain air pressure for holding the same while the head chuck 25 is moving. As above described, the head chuck 25 grasps and applies the tension to the section to convey it together with the chains 23.

The construction and operation of the head chuck lifter 38 which rises the head chuck 25 of the head chuck unit 6 at the starting point of conveyance and lower the head chuck 25 at the end of conveyance will be described with reference to FIGS. 2 and 3.

Lifter pedestals 39 are secured to the pit 19 beneath the starting position and end position respectively of conveyance of the head chuck 25. Each pedestal 39 is provided with a motor 40 and a pinion shaft 41 driven by the motor 40 through a belt. Vertical bearings 42 provided for respective pedestals 39 support chuck lifters 43 to be movable in the vertical direction, each chuck lifter 43 comprising a square plate and a vertical shaft. Each vertical shaft is formed with an integral rack 44 meshing with a pinion 45 secured to pinion shaft 41. With this construction, when the chuck lifter 43 at the conveyance starting position is at the descended position, and when head chuck 25 is conveyed by the lower run of the chains 23 and stopped above the chuck lifter 43, the motor 40 is rotated to raise the chuck lifter 43, thereby raising the head chuck 25 to the position of the upper run of the chains 23. When the chuck lifter 43 at the conveyance end side is raised, and when the head chuck 25 is conveyed and stopped at a position above the chuck lifter 43 by the upper run of the chains 23, the motor 40 would be rotated to lower the chuck lifter 43 thereby lowering the head chuck 25 to the lower run of the chains 23.

The run out tables 9 aligned in the same direction as the section shown in FIG. 1 will be described with reference to FIG. 6. Each run out table 9 has two pairs of criss-cross shaped links 12, respective pair being connected to one of bases 11 which are secured in the pit 10 under the right and left ends of the run out table 9. The lower ends 12*a* of the pair of criss-cross shaped links 12 are rotatably pivoted to the base 11, while the other lower ends 12*b* of the links 12 are slidably received in the base 11. The slidable ends 12*b* of the right and left links 12 are interconnected by connecting rods 13. One of the upper ends 12*c* of the links 12 are pivotably connected to beams 14 for supporting the table, while the other upper ends 12*d* of the links 12 slidably engage the beam 14. The run out table 9 comprises a bearing pedestal 9*a* secured to the upper surfaces of respective beams 14, bearings 9*b* secured on the beam 14 and a plurality of rollers 9*c* journalled by the bearings 9*b*. Along the opposite ends of each roller 9*c* are provided guide bars 9*d* slightly higher than the roller 9*c*. The connecting rods 13 are respectively coupled to the connecting rod of the run out table 9 of the intermediate conveyor unit 8. The interconnected connecting rods 9 are reciprocated by a drive source, not shown, so that all run out tables 9 are simultaneously raised and lowered together with the beam 14. The section conveyed by the puller 3 runs over rollers 9*c* of the run out tables 9 until it is stopped at a definite position.

Figure 7:
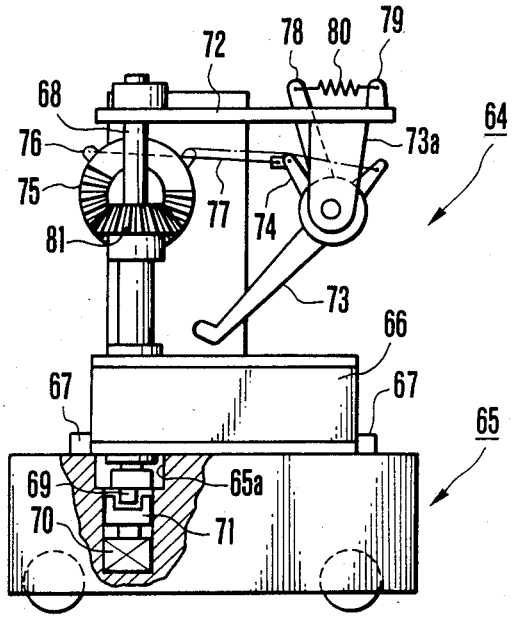
FIG. 7 is a front view of a tail chuck utilized in this invention.

The construction and operation of the tail chuck unit 7 that grasps and convey the tail end of the sections cut by saw 17 will be described with reference to FIGS. 1, 6 and 7.

More particularly, tail chuck lifters 46 identical to the head chuck lifters 38 are provided at three positions, that is right ends of two run out tables 9 of the tail chuck unit 7 and a position adjacent the run out table of the tail chuck returning unit 8. Each of the tail chuck lifter 46 comprises a pedestal 47, a pinion shaft 48 journaled by a bearing mounted on the pedestal 47 and driven by a motor, not shown, a pinion 49 secured to the pinion shaft 48, a vertical rack 51 engaging the pinion 49 and a chuck lifter 50 movable in the vertical direction together with the rack 51. When the shaft 48 is driven by the motor, this tail chuck lifter 46 simultaneously raises or lowers three chuck lifters 50.

The tail chuck 64 is provided with a self-running carriage 65 having a battery contained therein. The tail chuck 64 is constructed to be mounted on or removed from the self-running carriage 65 in a direction perpendicular to the direction of conveyance. A chuck base 66 is provided to freely slide along a projection 67 on the upper surface of the self-running carriage 65. A upright shaft 68 journalled by the chuck base 66 extends downwardly from the chuck base 66 to pass through an opening 65*a* of the self-running carriage 65. A projection 69 at the lower end of chuck shaft 68 removably engages with a U shaped coupling 71 provided for a rotary cylinder 70 of the self-running corriage 65. With this construction, the chuck shaft 68 is brought into a drive connection with a rotary cylinder 70 only when the base 66 rides on the self-running carriage 65, but when the chuck base 66 disengages from the self-running carriage 65 the driving connection to the chuck shaft 68 is interrupted.

A horizontal chuck supporting plate 72 is secured to the upper end of the chuck shaft 68 and rotated ninety degrees together with chuck shaft 68 to selectively assume a position in which the chuck supporting plate 72 projects toward the right as viewed in FIG. 1 and a position in which the chuck supporting plate 72 projects rearwardly. A square chuck plate 73 is pivotally supported by supporting levers 73*a* suspending from the chuck supporting plate 72. One arm 74 of the chuck plate 73 is connected to a projection 76 of a bevel gear 75 through a wire 77. Another arm 78 of the chuck plate 73 is connected to a projection 79 on the chuck supporting plate 72 through a spring 80 which urges the chuck plate 73 to open. A bevel gear 81 is provided to mesh with bevel gear 75 secured to the base 66. Portions of these bevel gears are removed so as not rotate the chuck plate 73 at the begining of rotation of the chuck supporting plate 72 rotating together with the chuck shaft 68, but the bevel gears 75 and 81 mesh with each other near the end of rotation of the chuck supporting plate 72 for rotating the chuck plate 73 from the horizontal position to the inclined position.

At the end position of conveyance and cooling of the section, there is provided a conveyor shaft 52 (FIG. 1) extending in the same direction but at a higher level than sprocket shaft 21 of the head chuck unit 6. The conveyor shaft 52 has a length equal to the sum of the length of the intermediate conveyor unit 8 and $\frac{2}{3}$ of the length of the tail chuck unit 7. The conveyor shaft 52 is driven by driving means, not shown, for driving sprocket shaft 21 through a chain. Between three sprocket wheels mounted on the conveyor shaft 52 and sprocket wheels mounted near respective chuck lifters 50 are provided tail chuck conveyors 53 extending at right angles with respect to the section and bonded with liners on their surfaces. A plurality of U shaped chuck holders 54 are provided for side surfaces of the tail chuck conveyors 53 at the same pitch as the pushers 23*a* of the head chuck chains 23. The chuck holders 54 engage the chuck base 66 for conveying the tail chucks 64. Chuck supporting bars 55 are disposed near respective tail chuck conveyors 53 in parallel therewith. The ends of respective tail chuck conveyors 53 are interconnected by chuck conveyors 57 through square chuck supporting member 56.

The tail chuck returning unit 5 that returns the tail chucks 64 conveyed by the tail chuck conveyors 53 from the end points to the starting points of conveyance will now be described. The tail chuck returning unit 5 comprises a conveyor 59 extending in the same direction as the conveyors 57, a conveyor 60 extending to the front side from the conveyance and cooling end point of the conveyor 57 at right angles with respect thereto, and a conveyance table 61 extending between the front end of conveyor 60 and the starting point of tail chuck conveyor 53. Thus, conveyors 59, 60 and conveyance table 61 are arranged in a letter U shape. Between conveyors 59 and 60 is disposed a tail chuck lifter 62 that transfers the tail chuck 64. Conveyors 59 and 60 are ordinary chain conveyors. Rails 63 are provided for the conveyor table 61 so that the tail chuck 64 can run along the rails 63. Either one of three tail chuck conveyors 53 is selected depending upon the cut length of the section. Where the section is short and the chuck conveyor 53 nearer to the head chuck unit 6 is used, the conveyor 57 and the run out table 9 are used to constitute the return path for the tail chuck 64 together with the tail chuck return unit 5.

The intermediate conveyor unit 8 is provided with a plurality of chain conveyors 82 in a direction perpendicular to the section for carrying the intermediate portion thereof. The front end of chain conveyor 82 is connected to a sprocket wheel disposed between run out tables 9, while the rear end of the chain conveyor 82 is connected to a sprocket wheel mounted on conveyor shaft 52.

The conveying and cooling apparatus having a construction described above operates as follows. Before the extrusion operation, one of the three tail chuck conveyors 53 is selected as the conveyance path on the tail side in accordance with length of the sections, and the cutter 15 is fixed to a desired position along the puller rails 4. The air cylinder 29 of the head chuck 25 is operated to set the grasping position of the sections. In the head chuck 25 the chuck plate 34 is opened to rotate the chuck supporting plate 33 away from the pass line of the sections, while the tail chuck lifter 46 of the tail chuck unit 7 is lowered as shown in FIG. 6 for opening the tail chuck 64. After these preparations have been completed, the extrusion is started. Then the extruded member is received by the initial table 2 and caught by the puller 3 through clamping member 16. The extruded member is pulled by the puller 3 running at the same speed as the extrusion speed and conveyed on the run out tables 9. The pulled end, that is the tail is inserted between the tail chuck plate 73 of tail chuck 64 and chuck base 66 and then stopped. After stopping, the clamping member 16 is closed and then the saw 17 is advanced to cut the member into sections of a predetermined length. Then the shaft 32 of the head chuck 25 is rotated for continuously rotating the chuck supporting plate 33 and the chuck plate 34 to grasp one end, that is the head, of the cut section. At the same time the chuck shaft 68 of the tail chuck 64 is rotated to rotate the chuck plate 73 for clamping the tail of the section between chuck plate 73 and chuck base 66. After grasping the opposite ends of the cut section, all the run out tables 9 are simultaneously lowered to the position shown in FIG. 6 by pulling the connecting rod 13 for supporting the intermediate portion of the section by the chain conveyor 82. Then conveyor shaft 52 is rotated to move one pitch the head chuck chain 23 and the tail chuck conveyor 53 thus engaging the pusher **23*a* against chuck holder 54, whereby the section is graspsed by the head chuck 25 and tail 64 and advanced one pitch. On the head side, before extrusion of the next member, the head chuck lifter 43 at the conveyance and cooling starting point is lowered and then raised for bringing the next head chuck 25 to the grasping position, while the head chuck lifter 43 at the conveyance and cooling end point is lowered and the head chuck 25** at the end position is lowered.

Figure 6:
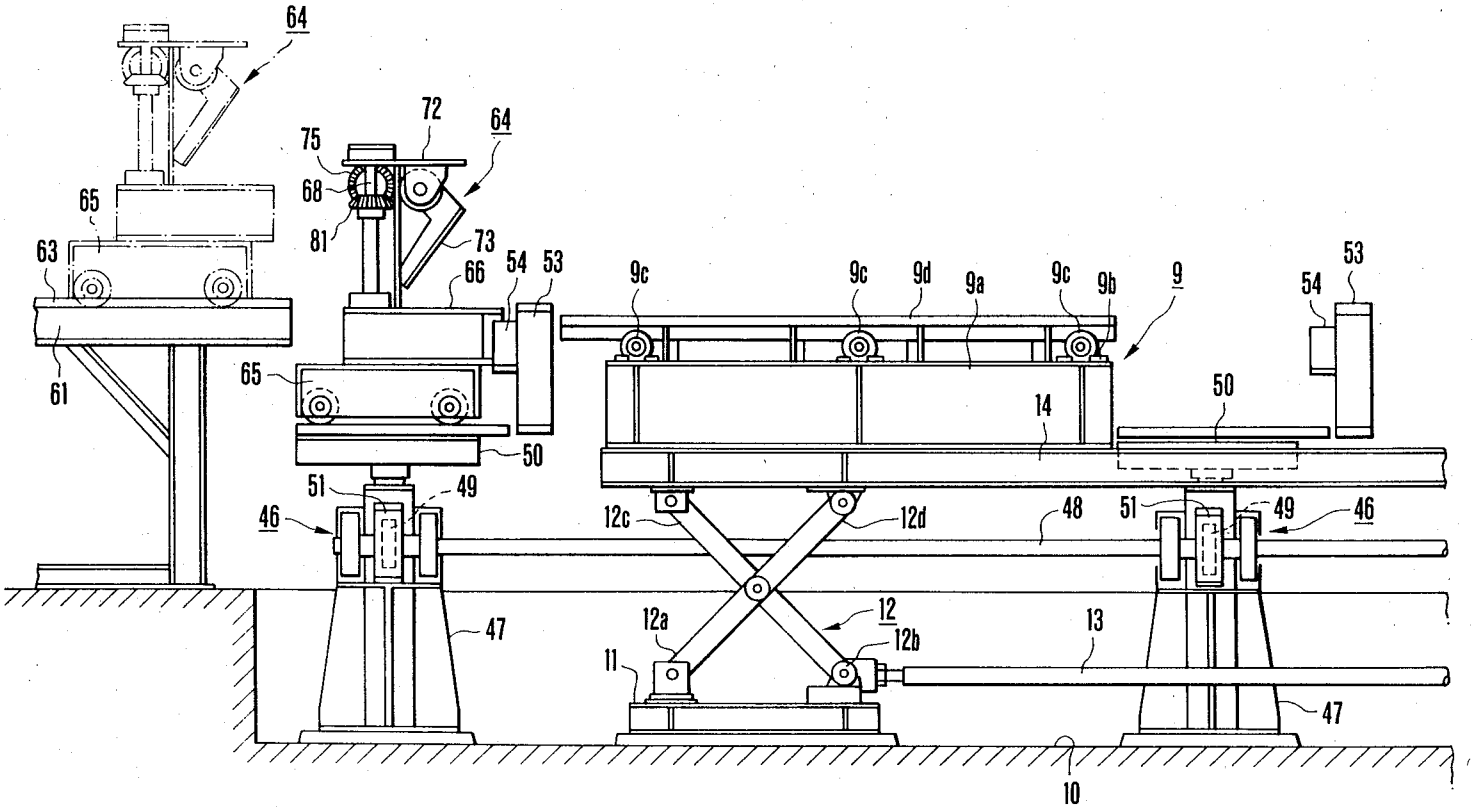
FIG. 6 is a front view of the lefthand portion of the apparatus shown in FIG. 1

On the tail side, the chuck lifter 50 is raised for moving the tail chuck 64 shown by dot and dash lines in FIG. 6 away from the conveyance table 61 while being mounted on the carriage 65. The tail chuck 64 pushed out at the end point of the tail chuck conveyor 53 is conveyed onto the tail chuck lifter 62 by conveyor 59 and then transferred to the starting point of the conveyance table 61 by conveyor 60. At this time, an idle carriage 65 is returned to the starting point of the conveyance table 61 and standing by, so that the projection of tail chuck 64 would engage the coupling 71 of the carriage 65, whereby rotation of the chuck supporting plate 73 and the chuck plate 72 effected by cylinder 70 is made possible. The tail chuck 64 on the chuck lifter 50 is advanced while leaving the carriage 65 on the chuck lifter 50. Since the opening **65*a* is a through hole, the engagement and the disengagement of the tail chuck 64 and the carriage 65 are free. As above described, each time the member is extruded and cut into sections, the head chuck chains 23 and the tail chuck conveyor 53 are advanced one pitch while repeating the operations described above so that the section is cooled while conveyed by the chain conveyor 82 with both ends grasped. The section advanced pitch by pitch is released from both chucks 25 and 64** at the end point of conveyance and cooling, and transferred onto a transfer table or the like leading to the next step.

Where the section is short, the tail chuck conveyor 53, conveyor 57 and run out table 9 of the second and third rows constitute a return path for the tail chuck 64.

As can be noted from the foregoing description, according to the section conveying and cooling apparatus embodying the invention, the opposite ends of each section obtained by cutting a long member sequentially conveyed onto a supporting table are grasped by the head chucks circulated by the cooperation of the chains and the lifters, and the tail chucks circulated by the self-running carriage and the conveyors, and the section is released at the end point of conveyance after being conveyed under a tension for correcting shrinkage, bending and twisting. Accordingly, the conveyance and cooling of the section can be effected automatically while preventing shrinkage, bending and twisting of the section.

What is claimed is:

1. A section conveying and cooling apparatus comprising:

an elongated table for supporting a member continuously supplied thereto at a start point of conveyance and cooling;

a cutter provided for the table for cutting the member into sections of predetermined length;

a plurality of head chucks for gasping head ends of said sections;

plurality of tail chucks for grasping tail ends of said sections, each ones of said head chucks and said tail chucks including means for gasping said sections and means for adjusting pulling forces applied to said sections and said head chuck and said tail chuck in pair sequentially conveying said sections in a direction perpendicular to said sections while maintaining said sections in parallel and at equal distances;

head chuck moving means provided at a head side of said sections, which runs along an endless path including forward, downward, rearward and upward paths which are contained in a plane perpendicular to an axis of said section, between a conveyance and cooling starting position and a conveyance and cooling ending position, and which has a chuck engaging means for engaging with said head chuck while it is moved horizontally but releasing said head chuck while the same is moved in the vertical direction;

head chuck elevating means respectively provided at forward and rearward limit positions of said head chuck moving means for raising and lowering said head chuck;

tail chuck moving means which is disposed on a tail side of said section to intersect the same, and forwardly moved at an equal speed as said head chuck moving means, and which includes a holding means for holding said tail chucks at the same spacing as said head chucks between said conveyance and cooling starting and end positions; and tail chuck returning means for transferring said tail chuck from said conveyance and cooling end position of said tail chuck moving means to said conveyance and cooling start position.

2. The apparatus according to claim 1 wherein said grasping means of said head chuck is withdrawn to clear a pass line when said member is pushed out, and is advanced to a position for grasping a head end of said section after the member is cut.

3. The apparatus according to claim 1 wherein said grasping means of said head chuck comprises grasping plates opening and closing at the forward and rearward limit positions of said head chuck moving means.

4. The apparatus according to claim 1 wherein said head chuck moving means comprises a pair of endless chains.

5. The apparatus according to claim 1 wherein a plurality of said tail chuck moving means are provided which are selectinvely used according to a length of said section.

6. The apparatus according to claim 1 wherein said tail chuck returning means comprises; a transfer path interconnecting said conveyance and cooling end position and said conveyanace and cooling start position of said tail chuck moving means, said transfer path being different from a path of said tail chuck moving means; and a self-running carriage which receives said tail chuck at said conveyance and cooling end position and transfers said tail chuck to said conveyance and cooling start position of said tail chuck moving means.

7. The apparatus according to claim 1 wherein a belt is provided between said head chuck moving means and said tail chuck moving means in parallel with said head and tail moving means for conveying a central portion of said section.

* * * * *